United States Patent [19]

Hoehn et al.

[11] Patent Number: 5,026,472

[45] Date of Patent: Jun. 25, 1991

[54] HYDROCRACKING PROCESS WITH INTEGRATED DISTILLATE PRODUCT HYDROGENATION REACTOR

[75] Inventors: Richard K. Hoehn, Mt. Prospect; Mark E. Reno, Villa Park, both of Ill.

[73] Assignee: UOP, Des Plaines, Ill.

[21] Appl. No.: 459,158

[22] Filed: Dec. 29, 1989

[51] Int. Cl.[5] ..... C10G 37/06; C10G 23/04

[52] U.S. Cl. ..... 208/58; 208/49; 208/112; 208/143

[58] Field of Search ..... 208/58

[56] References Cited

U.S. PATENT DOCUMENTS

| | | | |
|---|---|---|---|
| 2,671,754 | 3/1954 | DeRosset et al. | 196/28 |
| 3,026,260 | 3/1962 | Watkins | 208/68 |
| 3,365,388 | 1/1968 | Scott, Jr. | 208/59 |
| 3,592,757 | 7/1971 | Baral | 208/89 |
| 3,592,759 | 7/1971 | Pollitzer | 208/89 |
| 3,642,610 | 2/1972 | Divijak, Jr. et al. | 208/58 |
| 3,655,551 | 4/1972 | Hass et al. | 208/59 |
| 3,666,657 | 5/1972 | Thompson et al. | 208/58 |
| 3,852,207 | 12/1974 | Stangeland et al. | 208/58 |
| 3,870,622 | 3/1975 | Aston et al. | 208/58 |
| 3,962,071 | 6/1976 | Itoh et al. | 208/58 |
| 4,162,962 | 7/1979 | Stangeland | 208/58 |
| 4,238,316 | 12/1980 | Mooi et al. | 208/58 |
| 4,673,489 | 6/1987 | Miller | 208/58 |
| 4,875,991 | 10/1989 | Kukes et al. | 208/58 |

*Primary Examiner*—Helane E. Myers

*Attorney, Agent, or Firm*—Thomas K. McBride; John F. Spears, Jr.

[57] ABSTRACT

High boiling hydrocarbons are upgraded to products including low aromatic content kerosene or jet fuel in a dual reaction zone process. Feeds such as gas oils are fed to a hydrocracking reactor, with the effluent separated into vapor and liquid fractions. The vapor fraction is partially condensed to yield a liquid comprising kerosene/diesel boiling range hydrocarbons which is charged to a hydrogenation reactor. Liquid recovered from both reactors goes to a common fractionator. Vapor remaining after the partial condensation goes to the hydrogenation zone product separator to recover recycle hydrogen.

16 Claims, 1 Drawing Sheet

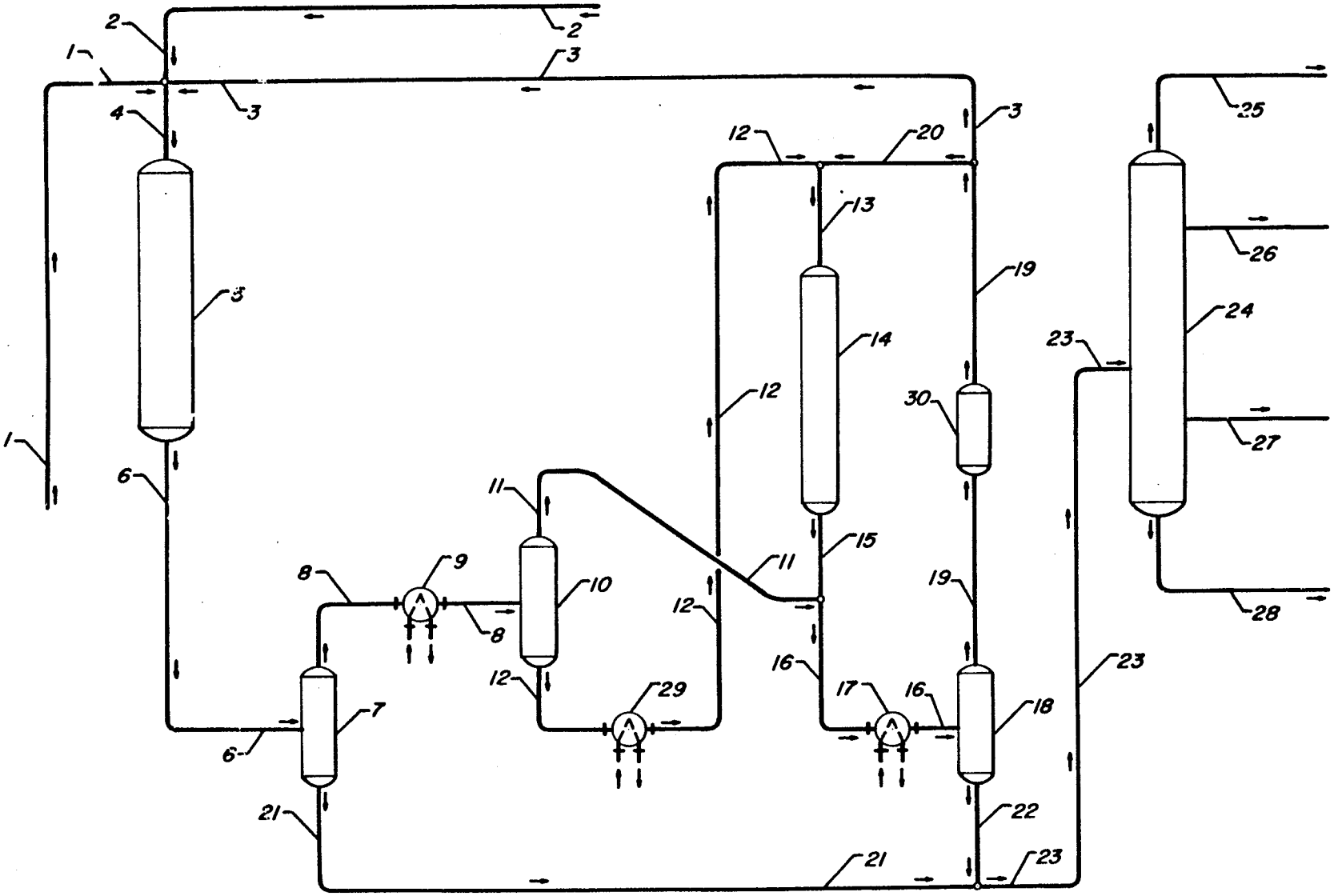
25
26
24
27
28
23
23
23
3
19
18
22
30
19
20
16
14
13
15
17
21
12
11
16
12
12
29
10
2
3
11
12
8
9
7
8
21
6
3
5
2
4
6
1
1

HYDROCRACKING PROCESS WITH INTEGRATED DISTILLATE PRODUCT HYDROGENATION REACTOR

FIELD OF THE INVENTION

The invention relates to a hydrocarbon conversion process used for upgrading residual petroleum fractions into more valuable products. The invention specifically relates to the hydrocracking of distillates, such as vacuum gas oils, to produce gasoline, kerosene and diesel fuel. The subject invention specifically relates to the hydrogenation of aromatic hydrocarbons present within the kerosene or diesel fuel products produced in the upstream catalytic hydrocracking reaction zone.

PRIOR ART

A hydrocracking process unit is often used in petroleum refineries for converting and upgrading distillate fractions. A review of hydrocracking catalysts, processing applications and flow schemes is provided in a paper by N. Choudhary et al. published at page 74 of *Industrial Engineering & Chemistry.* Prod. Res. Dev., Vol. 14, No. 2, 1975. This reference is also pertinent for its description of the well-known two-stage hydrocracking process flow wherein the effluent of a first hydrocracking stage is passed into a separation zone, with liquid collected in this separation zone being passed into a downstage reaction zone.

U.S. Pat. No. 2,671,754 issued to A. J. DeRosset et al. is believed pertinent for its showing of a two-zone process wherein a gas oil produced in a catalytic cracking zone 18 is passed into a hydrodesulfurization reactor 30. The effluent of the desulfurization reaction zone is passed into a separating and stripping zone intended to remove hydrogen sulfide from the hydrocarbons present in the effluent stream. The hydrocarbons are then passed into a hydrogenation reactor 50 which may contain a platinum on alumina catalyst. The hydrogenated product may be used as jet fuel or may be recycled to the catalytic cracking unit.

U.S. Pat. No. 3,026,260 issued to C. H. Watkins is believed pertinent for its teaching of the process flow used in a multistage hydrocracking process. This process comprises a first cracking zone, with the hydrocarbonaceous effluent of the first zone being passed into a fractionation zone which produces a lighter fraction having an 800° F. endpoint which is passed through a hydrogenation zone and a subsequent hydrocracking zone. That is, in this flow scheme a lighter distillate fraction is passed into the subsequent hydrotreating reaction zone.

U.S. Pat. No. 3,365,388 issued to J. W. Scott, Jr. is believed pertinent for its showing of a hydrocarbon conversion process employing separation means including a separator 68 of FIG. 2 and a catalytic hot stripper between two hydroconversion reactors. The lightest material from the separator 68 of FIG. 2 bypasses the second downstream reactor while the lightest fraction from the downstream catalytic hot stripper 72 is passed into the downstream reactor. The process is described as comprising at least 3 serially connected hydroconversion stages.

U.S. Pat. No. 3,592,758 issued to E. L. Pollitzer is believed pertinent for its showing of a two-stage process in which the charge stock is passed to the first reactor, with the effluent separated in a cold separator and a product separation zone. Several fractions are removed in the product separation zone with the heavy material and lightest material from the cold separator being passed into the downstream second reactor.

U.S. Pat. No. 3,655,551 issued to R. H. Hass et al. is believed pertinent for its showing of an integrated hydrocracking hydrogenation process. Upstream hydrocracking reactors are employed to produce gasoline and middle distillate fuels. Unconverted oil and middle distillate from the first zone may be passed in the substantial absence of hydrogen sulfide through a second reaction zone to substantially hydrogenate without hydrocracking the unconverted oil and middle distillate. The catalyst in the second zone may comprise a Group VIII noble metal hydrogenation component on a cracking catalyst support material.

BRIEF SUMMARY OF THE INVENTION

The invention is a hydrocracking process encompassing an integrated hydrogenation zone such that the overall process yields middle distillate products having low aromatic hydrocarbon contents. The invention is characterized by the passage of the effluent of a hydrocracking reaction zone into a first vapor-liquid separation zone, with the vapor removed from this first zone being partially condensed and passed into a second vapor-liquid separation zone. The process is operated such that the liquid removed from the second vapor-liquid separation zone contains the very great majority of the product middle distillate hydrocarbons which it is desired to hydrogenate. These middle distillate hydrocarbons together with recycle hydrogen are passed into a hydrogenation zone. The effluent of the hydrogenation zone and the vapor from the second vapor-liquid separation zone are passed into a third vapor-liquid separation zone which produces the recycle hydrogen stream of the process.

One embodiment of the invention may be characterized as a hydrocracking process which comprises the steps of passing a feed stream which comprises an admixture of hydrocarbons boiling above 240 degrees Centigrade and hydrogen through a hydrocracking reaction zone maintained at hydrocracking conditions and producing a mixed-phase first reaction zone effluent stream; separating the first reaction zone effluent stream into a first vapor stream, which comprises hydrogen, light hydrocarbons and kerosene boiling range hydrocarbons, and a first liquid stream, which comprises hydrocarbons boiling above the kerosene boiling range; forming a second vapor stream and a second liquid stream by partially condensing the first vapor stream, with the second liquid stream comprising kerosene boiling range hydrocarbons; passing the second liquid stream and added hydrogen through a hydrogenation zone maintained at hydrogenation conditions and producing a hydrogenation zone effluent stream; and, passing kerosene boiling range hydrocarbons present in the hydrogenation zone effluent stream and the first liquid stream into a fractionation zone, and recovering product hydrocarbons.

BRIEF DESCRIPTION OF THE DRAWING

The Drawing is a diagram of the subject hydrocracking process wherein feed from line 1 passes into hydrocracking reactor 5, with distillate hydrocarbons separated from the hydrocracking reactor effluent in separators 7 and 10 passing into a hydrogenation reactor 14.

DETAILED DESCRIPTION

Processes are known for upgrading essentially any heavy feedstock into more valuable lighter distillate products such as gasoline, kerosene and jet fuel. However, significant challenges remain in developing economically competitive processes which lower the cost of the conversion. It is an objective of the subject invention to provide one such process wherein residual feedstocks are converted to high value distillate products. Another objective of the subject invention is to reduce the operating cost (utilities cost) of hydrogenating aromatics present in the distillate cuts, such as naphtha and diesel fuel, produced in a hydrocracking process. Another objective of the subject invention is to minimize the amount of hydrogen consumed in the production of highly hydrogenated kerosene, diesel and jet fuel boiling range products.

The higher value of middle distillates as compared to residual feeds provides an economic incentive for their conversion as by catalytic cracking, thermal cracking, or hydrocracking. These middle distillates have several quality specifications including boiling range, sulfur content, etc. A high aromatics content in these distillates has been linked to such undesirable characteristics as a tendency to cause increased pollution when used as a fuel. Increasingly stringent quality standards are being contemplated and/or set for the maximum aromatic hydrocarbon content or for characteristics related to aromatic hydrocarbon content. It is therefore desirable to increase the degree of hydrogenation of the middle distillate fraction of the products slate of the hydrocracking reaction. At the same time the aromatic hydrocarbons present in the gasoline (naphtha) boiling range distillate fraction recovered from the hydrocracker are often valuable intermediates or feed materials. For instance, the benzene and xylenes may be recovered for use as feedstocks in petrochemical plants. Hydrogenation of the aromatics in the gasoline boiling range fraction has the undesirable effect of reducing the octane number of the gasoline. It is therefore normally undesirable to saturate the gasoline boiling range aromatics produced in a hydrocracking process.

The subject invention attempts to direct the input of the hydrogen consumed in aromatics saturation into the diesel and kerosene middle distillate fractions while minimizing the consumption of hydrogen in the hydrogenation of gasoline boiling range material. The manner in which the subject invention accomplishes these objectives is illustrated in the drawing.

Referring now to the drawing, a feedstream enters the process through line 1. The feedstream may comprise a vacuum gas oil or one of the other feed materials set out herein. The feedstream is combined with makeup hydrogen from line 2, hydrogen-rich recycle gas from line 3 and the combination of these materials is heated to reaction conditions in a fired heater not shown. The resultant charge stream is then passed into a hydrocracking reactor 5 via line 4. Recycling unconverted hydrocarbons from line 28 is a commonly employed option which is not shown on the drawing. The hydrocracking reactor 5 preferably contains a fixed bed of hydrocracking catalyst, which is maintained at hydrocracking conditions as set out herein. Contacting of the feedstream and hydrogen with the catalyst at these hydrocracking conditions results in the conversion of a significant portion of the feed hydrocarbons to lighter distillate hydrocarbons having lower boiling points in the range of naphtha, jet fuel and diesel fuel. There is thereby produced a mixed phase hydrocracking reaction zone effluent stream which is carried via line 6 into a first vapor-liquid separation zone 7.

The vapor-liquid separation zone 7 may contain a small amount of vapor-liquid contacting material or coalescing material to promote the separation of the two phases. However, the separation zone 7 preferably does not contain fractionation trays and according to the inventive concept would not comprise a fractional distillation column. The conditions of the entering hydrocracking reaction zone effluent stream are chosen to provide a mixed phase stream which may be separated within the first separator to produce a vapor phase stream removed through line 8 comprising hydrogen, light byproducts such as methane, ethane, propane, butane, pentane, gasoline boiling range hydrocarbons, and a very high percentage of the desired middle distillate boiling range hydrocarbons present in the hydrocracking reaction zone effluent stream. There is also withdrawn from the first vapor-liquid separation zone a liquid stream carried by line 21 which comprises some of the product distillate hydrocarbons. This stream also contains a very high percentage of the unconverted or slightly converted feed hydrocarbons of line 1 which are present in the hydrocracking reactor effluent stream.

It will be appreciated by those skilled in the art that the separation performed in a simple vapor-liquid separation vessel cannot effect a clean or 100% separation into two distinct boiling-point range fractions and that there will be an overlap in the composition of the vapor stream of line 8 and the liquid stream of line 21. For instance, some portion of the lighter materials which preferably would be in the vapor of line 8 will remain dissolved in the liquid phase stream of line 21. At the same time an equilibrium concentration of the heavier hydrocarbons, which preferably are withdrawn in line 21, will be present in the vapor of line 8.

Although it is possible to cool the hydrocracking reactor zone effluent stream flowing through line 6 prior to passage into the vapor-liquid separation zone 7, it is preferred that this is not done and that the material flowing into line 8 will have approximately the same temperature as the hydrocracking reaction zone effluent stream at the point it leaves the reactor 5.

The vapor stream flowing through line 8 is passed into a cooling means 9 where by indirect heat exchange a significant portion of the middle distillate hydrocarbons are condensed. This forms a mixed-phase stream carried into the second vapor-liquid separation zone 10. The vapor phase material flowing into the separation zone 10 will comprise hydrogen, methane, ethane, propane, other light hydrocarbons and hydrogen sulfide produced in the hydrocracking reaction zone 5. The vapor phase stream will also contain an equilibrium concentration of the heavier hydrocarbons of the gasoline and middle distillate boiling point ranges.

The conditions maintained within the second separator 10 are chosen to effect a partial separation at the approximate dividing point between gasoline boiling point hydrocarbons and the heavier distillate hydrocarbons. Therefore, preferably at least 75 percent of the gasoline boiling range hydrocarbons traveling through line 8 will exit from the second separator 10 as vapor phase material carried by line 11. It is preferred that at least 70 vol. % of the middle distillate (diesel and kerosene) boiling point range hydrocarbons flowing through line 8 are concentrated into a liquid phase stream removed from the second separator via line 12. It is also preferred that less than 25 vol. % of the hydrocarbons in the liquid stream of line 12 have boiling points below 204° C. Similar to the first separator, the second vapor-liquid separator may contain coalescing means to promote vapor-liquid separation but not equilibrium-type separation, and it is not intended to include or function as a fractionation column.

The liquid phase stream of line 12, which is also referred to herein as the second liquid stream, is heated as necessary by heat exchange means 29, which may be a fired heater. It is then admixed with recycle hydrogen from line 20 and passed via line 13 into a hydrogenation reactor 14. It is often desirable to heat the hydrocarbons after admixture with the hydrogen destined for the reaction zone. The hydrogen may therefore also be admixed upstream of heater 29. The hydrogenation reactor 14 contains a bed of suitable catalyst maintained at hydrogenation conditions. The effect of the contacting is saturation of some of the aromatic hydrocarbons entering the hydrogenation reactor and an increase in the hydrogen content of other hydrocarbons entering the reactor. Preferably there is only very limited or incidental hydrocracking performed in the hydrogenation reactor 14.

The hydrogenation reactor effluent stream of line 15 is admixed with the vapor phase stream of line 11 and passed via line 16 through a cooling means 17 wherein the admixture is cooled by indirect heat exchange. The indirect heat exchange preferably recovers heat for use in this or another process. The temperature of the materials flowing through line 16 may be reduced by the use of two or more cooling means. For instance, additional cooling could be performed downstream of the cooling means 17 through the use of air or water cooled heat exchangers. The material flowing through line 16 is preferably cooled to a temperature below 65° Centigrade prior to passage into separation zone 18.

The third vapor-liquid separation zone 18 is preferably a relatively high pressure separator similar to separators used in zones 7 and 10. That is, it is maintained at essentially reaction zone operating pressure reduced only by the incidental pressure drops caused by flow through the various lines and vessels of the process. As there is no intentional pressure reduction, as by the use of pressure reducing valves, within the process the two catalytic reaction zones and the three vapor-liquid separation zones operate at substantially the same elevated pressure. Vapor-liquid separator 18 therefore functions as a cold high pressure separator and separator 7 functions as a hot high pressure separator.

The vapor phase material collected within separator 18 will comprise hydrogen, light hydrocarbons such as methane, ethane and propane, and hydrogen sulfide which was produced in the hydrocracking reaction zone 5. The gas stream of line 19 is preferably passed through an acid gas removal zone 30. The function of this zone is the removal of hydrogen sulfide from the gas stream to lower the concentration of hydrogen sulfide in the gas stream charged to the hydrogenation reaction zone. Accordingly, the stream of recycle gas flowing through line 19 is purified prior to being divided into the two portions of recycle gas carried by lines 20 and 3. If desired, only the gas flowing in line 20 may be treated. Removal of hydrogen sulfide from the recycle gas stream may be performed by contact at high pressure with an aqueous amine stream as taught in U.S. Pat. No. 3,725,252 issued to W. H. Maier.

The liquid phase material removed from the first separation zone 7 in line 21 is combined with the liquid phase material accumulated within the third separation zone 18 and withdrawn through line 22. The admixture of these two streams is then passed into the fractionation zone 24 via line 23. Alternatively, the streams of lines 21 and 22 may be passed into the fractionation zone independently. This may be beneficial as they differ in composition. The fractionation zone 24 is preferably a single fractional distillation column. Multiple columns could be employed if further product separation is desired. The fractionation zone 24 is designed and operated to separate the entering hydrocarbons into at least two fractions and preferably three or more fractions. These fractions will normally include a light overhead stream removed through line 25 containing $C_3$ - $C_4$ hydrocarbons, a gasoline boiling range fraction removed through line 26, a kerosene or diesel fuel boiling range fraction removed through line 27 and a heavy boiling bottoms product removed through line 28 for use as fuel oil. If desired, a portion of the unconverted material forming the bottoms product may be recycled to the hydrocracking reactor inlet via line 4.

Those skilled in the art will recognize that numerous pieces of process equipment and ancillary apparatus are not illustrated on the drawing. For instance, the drawing does not illustrate a hydrogen bleed line used to remove any accumulated light materials although such a stream may be employed. The drawing also does not illustrate the placement of compressors, flow control valves, flow control systems, the reboiler and overhead system required on the fractionation zone 24 and other equipment. Such equipment may be of customary nature.

The reaction zone effluent of a conventional hydrocracking process is typically removed from the catalyst bed, heat exchanged with the feed to the reaction zone and then passed into a vapor-liquid separation zone often referred to as a high pressure separator. Additional cooling can be done prior to this separation. In some instances a hot flash separator is used upstream of the high pressure separator. The vapor phase from the separator(s) is further cooled and if desired treated to remove hydrogen sulfide prior to use as recycle gas. The liquid phase is customarily passed into a fractionation zone.

In the subject process the hydrocracking reaction zone effluent is separated into vapor and liquid fractions, with the vapor phase fraction being subjected to a partial condensation. Conditions are adjusted such that the liquid condensed in the partial condensation step is rich in the middle distillate hydrocarbons present in the hydrocracking zone effluent material. This condensed material is then passed through a hydrogenation zone to selectively hydrogenate the desired middle distillate fraction. The majority of the $H_2S$ present in the hydrocracking reaction zone effluent remains in the vapor phase and hence is not passed into the hydrogenation zone, thereby increasing the hydrogenation activity of the catalyst maintained therein.

It is highly preferred that the effluent of the hydrocracking reaction zone is a mixed-phase stream. However, it is envisioned that the effluent stream could be a vapor phase stream if high conversion hydrocracking conditions are maintained and/or a light feed stream is processed. In this instance it would be necessary to extract heat from the effluent stream and cause a desired degree of condensation as by indirect heat exchange upstream of the first separation zone. Admixture with a cool fluid would have a similar effect.

Those of ordinary skill in the art of petroleum process engineering are able to calculate with a high degree of accuracy the distribution of a mixture of hydrocarbons between liquid and vapor phases at any set temperature and pressure. The operating conditions of the first, second and third separation zones can be chosen based upon these calculations or reference materials to yield the desired separations. For purposes of exemplifying the subject process, the first separation zone may be operated at a pressure of 1500 psi (103450 kPa) at a temperature of about 800° F. (427° C.). The second separation zone may be operated at a pressure of 1400 psi (96600 kPa) at a temperature of about 700° F. (371° C.). These conditions are for one feed and one hydrocracking zone conversion rate. Adjustment will be needed based upon such factors as reactor effluent composition and hydrogen circulation rates.

The subject process is especially useful in the production of middle distillate fractions boiling in the range of about 300°-700° F. (149°-371° C.) as determined by the appropriate ASTM test procedure. The kerosene boiling range is intended to refer to about 300°-450° F. (149°-232° C.) and diesel boiling range is intended to refer to hydrocarbon boiling points of about 450° - about 700° F. (232°-371° C.). Gasoline is normally the $C_5$ to 400° F. (204° C.) endpoint fraction of available hydrocarbons. The boiling point ranges of the various product fractions will vary depending on specific market conditions, refinery location, etc. One common variation is the production of light and heavy naphtha fractions.

The hydrocracking reactions will reduce the average molecular weight of the feed stream hydrocarbons resulting in the production of gasoline and middle distillate (kerosene and diesel fuel) boiling range hydrocarbons and some lighter but valuable by-products such as LPG. In addition, other useful hydroprocessing reactions such as hydrodenitrification and hydrodesulfurization will occur simultaneously with hydrocracking of the feedstock. This leads to the production of hydrogen sulfide and ammonia and their presence in the hydrocracking zone effluent stream.

Typical feedstocks include virtually any heavy mineral oil and fractions thereof. Thus, such feedstocks as straight run gas oils, vacuum gas oils, demetallized oils, deasphalted vacuum residue, coker distillates, cat cracker distillates, shale oil, tar sand oil, coal liquids, and the like are contemplated. The preferred feedstock will have a boiling point range starting at a temperature above 160° Celsius but would not contain appreciable asphaltenes. It is preferred that less than about 25 volume percent of the hydrocarbons in the feed stream have boiling points below about 240 degrees C. Feedstocks with end boiling points under about 830° F. (443° C.) are preferred. Preferred feedstocks include gas oils having at least 50% volume of their components boiling above 700° F. (371° C.). The feedstock may contain nitrogen usually present as organonitrogen compounds in amounts between 1 ppm and 1.0 wt. %. The feed will normally contain sulfur-containing compounds sufficient to provide a sulfur content greater than 0.15 wt. %. It may also contain mono- and/or polynuclear aromatic compounds in amounts of 50 volume percent and higher.

Hydrocracking conditions employed in the subject process are those customarily employed in the art for hydrocracking equivalent feedstocks. Hydrocracking reaction temperatures are in the range of 400° to 1200° F. (204°-649° C.), preferably between 600° and 950° F. (316°-510° C.). Reaction pressures are in the range of atmospheric to about 3,500 psi (24,233 kPa), preferably the hydrogen partial pressure is between 1000 and 2000 psi (6,895-13,790 kPa). Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178-8,888 std. $m^3/m^3$), preferably between 5,000 and 30,000 scf per barrel of charge (887-5,333 std. $m^3/m^3$).

The subject process is not restricted to the use of a specific hydrocracking catalyst. Different types of hydrocracking catalysts can therefore be employed effectively in the subject process. For instance, the metallic hydrogenation components can be supported on a totally amorphous base or on a base comprising an admixture of amorphous and zeolitic materials. The nonzeolitic hydrocracking catalysts will typically comprise a support formed from silica-alumina and alumina. In some instances, a clay is used as a component of the nonzeolitic catalyst base.

Many hydrocracking catalysts are prepared using a starting material having the essential X-ray powder diffraction pattern of zeolite Y set forth in U.S. Pat. No. 3,130,007. A zeolitic starting material may be modified by techniques known in the art which provide a desired form of the zeolite. Thus, the use of modification techniques such as hydrothermal treatment at increased temperatures, dealumination and calcination is contemplated. A Y-type zeolite preferred for use in the present invention preferably possesses a unit cell size between about 24.20 Angstroms and 24.45 Angstroms. More preferably the zeolite unit cell size will be in the range of about 24.20 to 24.40 Angstroms and most preferably about 24.30 Angstroms. The zeolite is preferably a stabilized or ultrastable Y zeolite. The catalyst may comprise an admixture of two modified Y zeolites such as described in U.S. Pat. No. 4,661,239. The zeolite may be treated to increase its silica to alumina ratio by insertion of silica as described in U.S. Pat. Nos. 4,576,711 and 4,503,023 and in European Patent Application 88-361660 assigned to Akzo NV. The use of a zeolite having a silica-alumina framework ratio above 8.0 is preferred.

A zeolitic type hydrocracking composite containing no amorphous material can be produced but it is preferred that zeolitic catalysts contain between 2 wt. % and 20 wt. % of the Y-type zeolite, and more preferably between 2 wt. % and 10 wt. %. The zeolitic catalyst composition should also comprise a porous refractory inorganic oxide matrix which may form between 2 and 98 wt. %, and preferably between 5 and 95 wt. % of the support of the finished catalyst composite. The matrix may comprise any known refractory inorganic oxide such as alumina, magnesia, silica, titania, zirconia, silica-alumina and the like and combinations thereof which are suitable as hydrocracking catalyst components. A preferred matrix comprises silica-alumina or alumina. The most preferred matrix comprises a mixture of silica-alumina and alumina wherein said silica-alumina comprises between 5 and 45 wt. % of said matrix. It is also preferred that the support comprises from about 5 wt. % to about 45 wt. % alumina.

A silica-alumina component may be produced by any of the numerous techniques which are well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

A finished catalyst for utilization in the hydrocracking zone should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2$/gm are greatly preferred.

An alumina component of the hydrocracking catalyst may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The precise physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the catalyst may be prepared in a suitable form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed into the reactors and in either upward or downward flow. The catalyst particles may be prepared by any known method in the art including the well-known oil drop and extrusion methods.

Although the hydrogenation components may be added to both the hydrocracking and hydrogenation catalysts before or during the forming of the support, hydrogenation components are preferably composited with the catalyst by impregnation after the selected zeolite and/or amorphous inorganic oxide materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on the preparation of suitable hydrocracking may be obtained by reference to U.S. Pat. Nos. 4,422,959; 4,576,711; 4,661,239; 4,686,030; and, 4,695,368 which are incorporated herein by reference.

Hydrogenation components contemplated for both catalysts are those catalytically active components selected from Group VIB and Group VIII metals and their compounds. References herein to the Periodic Table are to that form of the table printed adjacent to the inside front cover of *Chemical Engineer's Handbook*, edited by R. H. Perry, 4th edition, published by McGraw-Hill, copyright 1963. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated include one or more metals chosen from the group consisting of molybdenum, tungsten, chromium, iron, cobalt, nickel, platinum, palladium, iridium, osmium, rhodium, rudinium and mixtures thereof. The hydrocracking catalyst preferably contains two metals chosen from cobalt, nickel, tungsten and molybdenum.

The hydrogenation components of the catalysts will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrocracking catalyst. Usually phosphorus is present in the catalyst in the range of 1 to 30 wt. % and preferably 3 to 15 wt. % calculated as $P_2O_5$. In addition, boron may also be present in the hydrocracking catalyst.

A wide variety of materials described in the available references are suitable as hydrogenation catalysts. The hydrogenation catalyst preferably comprises a hydrogenation component comprising one or more metal or hydrogenation components supported on a refractory inorganic oxide base. The preferred metals are the noble metals, especially platinum and palladium although the catalyst may also if desired contain iron, nickel, cobalt, tungsten, or molybdenum. The base material is preferably alumina although other materials may be present in admixture with the alumina or the base material may be comprised solely of another material. Examples of such suitable materials are titania or a synthetic zeolitic material having a low cracking activity. Preferably the hydrogenation catalyst is nonzeolitic. Base materials of low acidity such as commonly used in isomerization processes are therefore normally suitable for use as the base material in the hydrogenation zone.

An example of a highly suitable and preferred hydrogenation catalyst is a material containing 0.15 wt. % platinum uniformly dispersed upon 0.16 cm (1/16 inch) extruded alumina. Due to the expensive nature of the noble metals they are used at relatively low concentrations ranging from 0.1 to 0.375 wt. % of the finished composite. Silica may also be used as a support material, but due to its tendency to be acidic it is preferably a lithiated silica or silica which has been treated by some means to reduce its acidity. Another mechanism known in the art for reducing the acidity or cracking tendency of support materials is the passage of ammonia into the reactor in combination with the charge material. The use of this technique is not preferred in the subject process.

More information on the usage and formulation of noble metal catalysts for hydrogenation may be obtained by reference to U.S. Pat. Nos. 3,764,521; 3,451,922; and 3,493,492. The high cost of the noble metals has led to efforts to seek substitutes. Specifically, in U.S. Pat. No. 3,480,531 issued to B. F. Mulaskey there is described a catalyst comprising between 5 and 30 wt. % combined nickel and tin. This material is preferably supported on a lithiated silica and it is described as being suitable for the hydrogenation of jet fuel fractions derived from hydrocracking to increase the smoke point of the jet fuel and render it highly paraffinic.

The hydrogenation of distillate fractions such as kerosene is addressed in European Patent Office Publication 303332 of 02/15/1989, based upon Application 88201725.4 assigned to Shell International Research MIJ BV, which is incorporated herein by reference for its description of hydrogenation catalyst and methods. A specific usage of the catalyst of this application is the increase in cetane number of a cycle oil and the hydrogenation of kerosene for smoke point improvement without substantial hydrocracking. The catalyst comprises a Group VIII metal on a support comprising a modified Y-type zeolite of unit cell size 24.20–24.30 Angstroms and a silica to alumina mole ratio of at least 25 e.g. 35–65. Platinum or palladium on a dealuminated Y zeolite is an exemplary catalyst. Hydrogenation is performed at 225–300 degrees C at a hydrogen partial pressure of 30–100 bar.

A study of the conditions useful in the saturation of diesel fuel aromatics, the effects of varying these conditions on the products, product properties and other factors involved in using a specific commercially available hydrogenation catalyst is presented in an article at page 47 of the May 29, 1989 edition of the *Oil and Gas Journal*. This article is incorporated herein by reference for its teaching in regard to the hydrogenation of middle distillates.

Hydrogenation conditions used in the subject process are somewhat dependent on the operating conditions in the upstream hydrocracking reactor because there will only be a relatively minor pressure loss through the lines and vessels connecting the exit of the hydrocracking reactor and the entrance to the hydrogenation reactor. The primary pressure drop will be in the reactor, heater and heat exchanger. The pressure range (hydrogen partial pressure) for the hydrogenation zone is therefore from about 900–1,800 psia (6,206–12,411 kPa). The hydrogenation zone is preferably operated at a higher liquid hourly space velocity than the hydrocracking zone. A liquid hourly space velocity of 1.5 to 4.5 is preferred. The hydrogenation zone is preferably operated with a hydrogen to hydrocarbon ratio of about 5,000 to 18,000 std. cubic feet hydrogen per barrel of feedstock (889 to 3200 std. meter$^3$ per meter$^3$). The hydrogenation zone may be operated at a temperature of about 600 to 730 degrees F (316°–388° C.).

A typical feed stream is a vacuum gas oil derived from light Arabian crude having the properties set out in Table 1. The objective of the operation is to maximize the production of 385° C. (725° F.) end point distillate. A typical product distribution is given in Table 2.

TABLE 1

| Feed Properties | |
|---|---|
| °API | 21.6 |
| Sp. Gravity | 0.9242 |
| Wt. % Sulfur | 2.45 |
| Total N, ppm | 900 |
| Con. Carbon, wt. % | 0.49 |
| $C_7$ Insol, wt. % | <0.05 |
| Ni & V, wt. ppm | 0.4 |
| Initial BP °C. | 392 |
| 50% BP °C. | 456 |
| End BP °C. | 583 |

TABLE 2

| | Product Distribution | | |
|---|---|---|---|
| | Wt. % | Vol. % | API Gravity |
| $NH_3$ | 0.11 | | |
| $H_2S$ | 2.60 | | |
| $C_1$ | 0.30 | | |
| $C_2$ | 0.44 | | |
| $C_3$ | 0.93 | | |
| $C_4$ | 1.71 | 2.74 | |
| $C_5$ | 2.09 | 3.08 | |
| $C_6$ | 2.75 | 3.69 | |
| $C_7$-149° C. | 5.67 | 6.99 | 57.3 |
| 149–288° C | 43.88 | 49.84 | 42.4 |
| 288–385° C | 41.49 | 45.28 | 35.6 |
| Total | 101.97 | 111.62 | |

One embodiment of the invention may accordingly be broadly characterized as a hydrocarbon conversion process which comprises the steps of passing a feed stream which comprises an admixture of hydrocarbons boiling above 240 degrees Centigrade and hydrogen through a hydrocracking reaction zone maintained at hydrocracking conditions and producing a hydrocracking reaction zone effluent stream; separating the hydrocracking reaction zone effluent stream into a first vapor stream, which comprises hydrogen, light hydrocarbons and distillate range hydrocarbons, and a first liquid stream, which comprises distillate hydrocarbons; forming a second vapor stream and a second liquid stream by partially condensing the first vapor stream, with the second liquid stream comprising distillate hydrocarbons and having a lower average boiling point than the first liquid stream; passing the second liquid stream and added hydrogen through a hydrogenation reaction zone containing a bed of hydrogenation catalyst maintained at hydrogenation conditions and producing a hydrogenation zone effluent stream; passing the hydrogenation zone effluent stream into a vapor-liquid separation zone, removing a third vapor stream, which comprises hydrogen, and a third liquid stream, which comprises distillate hydrocarbons, from the separation zone; passing the third liquid stream and the first liquid stream into a fractional distillation zone and recovering product distillate hydrocarbons from the fractional distillation zone.

What is claimed:

1. A hydrocracking process which comprises the steps of:

a) passing a feed stream which comprises an admixture of hydrocarbons boiling above 240 degrees Centigrade and hydrogen through a hydrocracking reaction zone maintained at hydrocracking conditions and producing a mixed-phase hydrocracking reaction zone effluent stream;

b) separating the mixed-phase hydrocracking reaction zone effluent stream into a first vapor stream, which comprises hydrogen, light hydrocarbons and distillate hydrocarbons, and a first liquid stream, which comprises distillate hydrocarbons;

c) forming a second vapor stream and a second liquid, stream by partially condensing the first vapor stream, with the second liquid stream comprising distillate hydrocarbons and having a lower average boiling point than the first liquid stream;

d) passing the second liquid stream and added hydrogen through a hydrogenation reaction zone maintained at hydrogenation conditions and producing a hydrogenation zone effluent stream; and, e) passing distillate hydrocarbons present in the hydrogenation zone effluent stream and the first liquid stream into a fractionation zone, and recovering a hydrocracking zone product stream.

2. The process of claim wherein the hydrogenation zone effluent stream is passed into a vapor-liquid separation zone, a third vapor stream, which comprises hydrogen, and a third liquid stream are removed from the separation zone, and the third liquid stream and the first liquid stream are passed into a fractional distillation zone.

3. The process of claim 2 wherein a portion of the third vapor stream is passed into the hydrocracking reaction zone as recycle hydrogen.

4. The process of claim 2 wherein a portion of the third vapor stream is passed into the hydrogenation zone as a hydrogen source.

5. The process of claim 1 wherein less than 10 volume percent of the hydrocarbons in the feed stream have boiling points below about 240 degrees C.

6. The process of claim 1 wherein the hydrogenation zone contains a bed of a catalyst comprising platinum or palladium.

7. The process of claim 6 wherein less than 25 vol. percent of the hydrocarbons in the second liquid stream have boiling points below 204 degrees C.

8. A hydrocracking process which comprises the steps of:

a) passing a feed stream which comprises an admixture of hydrocarbons boiling above 240 degrees Centigrade and hydrogen through a hydrocracking reaction zone maintained at hydrocracking conditions and producing a mixed-phase first reaction zone effluent stream;

b) separating the first reaction zone effluent stream into a first vapor stream, which comprises hydrogen, light hydrocarbons and kerosene boiling range hydrocarbons, and a first liquid stream, which comprises hydrocarbons boiling above the kerosene boiling range;

c) forming a second vapor stream and a second liquid stream by partially condensing the first vapor stream, with the second liquid stream comprising kerosene boiling range hydrocarbons;

d) passing the second liquid stream and added hydrogen through a hydrogenation reaction zone maintained at hydrogenation conditions and producing a hydrogenation zone effluent stream; and, e) passing kerosene boiling range hydrocarbons present in the hydrogenation zone effluent stream and the first liquid stream into a fractionation zone, and recovering a hydrocracking zone product stream.

9. The process of claim 8 wherein the hydrogenation zone effluent stream is passed into a vapor-liquid separation zone, a third vapor stream, which comprises hydrogen, and a third liquid stream are removed from the separation zone, and the third liquid stream and the first liquid stream are passed into a fractional distillation zone.

10. The process of claim 9 wherein a portion of the third vapor stream is passed into the hydrocracking reaction zone as recycle hydrogen.

11. The process of claim 8 wherein less than 10 volume percent of the hydrocarbons in the feed stream have boiling points below 240 degrees C.

12. The process of claim 8 wherein the hydrogenation zone contains a bed of a catalyst comprising platinum or palladium.

13. The process of claim 8 wherein less than 25 vol. percent of the hydrocarbons in the second liquid stream have boiling points below 204 degrees C.

14. A hydrocracking process which comprises the steps of:

a) passing a feed stream which comprises an admixture of hydrocarbons boiling above 240 degrees Centigrade and hydrogen through a hydrocracking reaction zone maintained at hydrocracking conditions and producing a mixed-phase first reaction zone effluent stream;

b) separating the first reaction zone effluent stream into a first vapor stream, which comprises hydrogen, light hydrocarbons and kerosene boiling range hydrocarbons, and a first liquid stream, which comprises hydrocarbons boiling above the kerosene boiling range;

c) forming a second vapor stream and a second liquid stream by partially condensing the first vapor stream, with the second liquid stream comprising kerosene boiling range hydrocarbons;

d) passing the second liquid stream and added hydrogen through a hydrogenation reaction zone containing a bed of hydrogenation catalyst comprising platinum or palladium maintained at hydrogenation conditions and producing a hydrogenation zone effluent stream;

e) passing the hydrogenation zone effluent stream passed into a vapor-liquid separation zone, removing a third vapor stream, which comprises hydrogen, and a third liquid stream from the separation zone; and, f) passing the third liquid stream and the first liquid stream into a fractional distillation zone and recovering a hydrocracking zone product stream from the fractional distillation zone.

15. The process of claim 14 wherein a portion of the third vapor stream is passed into the hydrocracking reaction zone as recycle hydrogen.

16. The process of claim 14 wherein a portion of the third vapor stream is passed into the hydrogenation zone as a hydrogen source.

* * * * *